US007676144B2

(12) United States Patent
Zeyen et al.

(10) Patent No.: US 7,676,144 B2
(45) Date of Patent: Mar. 9, 2010

(54) HEAT-GENERATING ELEMENT OF A HEATING DEVICE

(75) Inventors: Michael Zeyen, Herxheim-Hayna (DE); Kurt Walz, Hagenbach (DE); Michael Niederer, Kapellen-Drusweiler (DE); Franz Bohlender, Kandel (DE)

(73) Assignee: Catem GmbH & Co. KG, Herxheim Bei Landau (DE)

( * ) Notice: Subject to any disclaimer, the term of this patent is extended or adjusted under 35 U.S.C. 154(b) by 0 days.

(21) Appl. No.: 11/534,401

(22) Filed: Sep. 22, 2006

(65) Prior Publication Data

US 2007/0068914 A1 Mar. 29, 2007

(30) Foreign Application Priority Data

Sep. 23, 2005 (EP) ..... 05020753

(51) Int. Cl.
*H05B 3/12* (2006.01)

(52) U.S. Cl. ..... 392/502; 219/525; 219/520; 392/347

(58) Field of Classification Search ..... 219/202, 219/504, 505, 520, 530, 537, 540, 541, 544, 219/548, 553; 392/480, 347; 156/291, 292
See application file for complete search history.

(56) References Cited

U.S. PATENT DOCUMENTS 4,371,777 A * 2/1983 Roller et al. ..... 392/480
4,931,626 A * 6/1990 Shikama et al. ..... 219/540
5,326,418 A * 7/1994 Yeh ..... 156/291
5,471,034 A * 11/1995 Kawate et al. ..... 219/485
5,995,711 A * 11/1999 Fukuoka et al. ..... 392/347
6,720,536 B2 * 4/2004 Bohlender ..... 219/504

FOREIGN PATENT DOCUMENTS

| | | |
|---|---|---|
| DE | 102 13 923 A1 | 10/2003 |
| EP | 1 515 588 A1 | 3/2005 |
| JP | 4-36071 | 8/1992 |
| JP | 6-73654 | 10/1994 |

* cited by examiner

*Primary Examiner*—Thor S Campbell
(74) *Attorney, Agent, or Firm*—Boyle Fredrickson, S.C.

(57) ABSTRACT

A heat-generating element of a heating device for heating air includes at least one PTC element and, lying on opposing side surfaces of the PTC element, electric strip conductors. A heat-generating element that is improved with respect to the safety against electric flashovers is created with the invention under consideration by means of surrounding the two electric strip conductors on the outside by a non-conductive insulating layer. A heating device for heating air with multiple heat-generating elements is also disclosed with each heating element including at least one PTC element and, lying on opposing side surfaces of the PTC element, electric strip conductors and multiple heat-emitting elements that are arranged in parallel layers and that are held in position lying on opposing sides of the heat-generating element. The heat-emitting elements are essentially potential-free and protected against electric flashovers with a higher degree of certainty due to the fact that the heat-emitting elements lie on opposing sides of the heat-generating element, with an insulating layer placed in between.

17 Claims, 5 Drawing Sheets

HEAT-GENERATING ELEMENT OF A HEATING DEVICE

BACKGROUND OF THE INVENTION

1. Field of the Invention

The invention under consideration relates to a heat-generating element of a heating device for heating air, comprising at least one PTC element and, lying on opposing side surfaces of the PTC element, electric strip conductors. Such a heat-generating element is known, for example, from EP 1 061 776, which is traced back to the current applicant.

In particular, the heat-generating element is deployed in an auxiliary heater for a motor vehicle, and comprises multiple PTC elements, arranged in a row, one behind the other, that are energized via electric strip conductors that extend parallel to one another and that lie flat on opposing sides of the PTC elements. The strip conductors are normally formed by parallel strips of metal. The heat-generating elements formed in this way are deployed in a heating device for heating air in a motor vehicle, where said heating device comprises multiple layers of heat-generating elements having heat-emitting elements that lie on their opposing sides. These heat-emitting elements are positioned so that they lie against the heat-generating elements in a relatively good heat-transferring contact by means of a holding device.

2. Description of the Related Art

With the aforementioned state of the art, a holding device of the heating device is formed by a frame in which multiple layers of heat-generating and heat-emitting elements that run parallel to one another are held by means of a spring bias. In an alternative development, which likewise discloses a generic heat-generating element and a generic heating device and that is described, for example, in EP 1 467 599, the heat-generating element is formed by multiple PTC elements arranged one behind the other, in a row in one level, said PTC elements also being called ceramic elements or positive temperature coefficient thermistors, and being energized on opposing side surfaces by strip conductors that lie on these side surfaces. One of the strip conductors is formed by a circumferentially closed profile, and the other strip conductor by a strip of metal that is supported at the circumferentially closed metal profile with an electrically insulating layer in between. The heat-emitting elements are formed by segments arranged in multiple parallel layers, said segments extending at right-angles to the circumferentially closed metal profile. In the generic heating device known from EP 1 467 599, multiple circumferentially closed metal profiles formed in the manner described in the preceding are provided, said metal profiles being arranged parallel to one another. To some extent, the segments extend between the circumferentially closed profiles and project beyond them to some extent.

In the case of the aforementioned heat-generating elements, there is a requirement that the electric strip conductors must be in good electrical contact with the PTC elements. Otherwise, the problem that arises is an increased transition resistance, which, particularly in the case of the use of the heat-generating elements in auxiliary heaters for motor vehicles, can lead to local overheating due to the high currents. As a result of this thermal event, the heat-generating element can be damaged. Furthermore, the PTC elements are self-regulating resistance heaters that emit a lower heat output at an increased temperature, so that local overheating can lead to a disturbance in the self-regulating characteristics of the PTC elements.

In addition, at high temperatures in the area of an auxiliary heater, vapours or gases can develop that can result in a direct hazard for persons in the passenger compartment.

Correspondingly problematic is also the use of generic heat-generating elements at high operating voltages, such as voltages up to 500 V, for example. For one thing, a problem here is that the air that flows against the heat-emitting elements carries moisture and/or dirt with it, which can penetrate into the heating device and cause an electric flashover, i.e., a short-circuit, here. On the other hand, there is fundamentally the problem of protecting persons working in the area of the heating device from the current-carrying parts of the heating device or of the heat-generating element.

OBJECT OF THE INVENTION

The object of the invention under consideration is to provide a heat-generating element of a heating device for heating air, as well as a corresponding heating device, offering increased safety. At the same time, the invention under consideration particularly seeks to increase the safety with regard to a possible electric flashover.

To solve this problem, the invention under consideration further develops a generic heat-generating element by providing a non-conductive insulating layer on the outer side of the two electric strip conductors. This insulating layer is an electrically non-conductive layer. By means of the non-conducting electric insulating layer, the large-surfaced upper and lower sides of the PTC elements and the electric strip conductors are electrically insulated on the outer side. This prevents dirt or splash water from coming into direct contact with the current-carrying electric strip conductors. In the case of the heat-generating element known from EP 1 467 599, the invention is realized, for example, by means of surrounding the circumferentially closed metal profile with an insulating layer. For the heat-generating element of EP 1 061 776, at least the strips of metal forming the electric strip conductors are, for example, surrounded by an insulating layer.

The insulating layer should preferably be placed directly against the electric strip conductors, so that the heat transport from the heat-generating elements to the heat-emitting elements is impeded only to a slight degree. The insulating layer should have the best possible thermal conductivity. Aimed at is a thermal conductivity of more than 20 W/(m K). An insulating layer with electrical insulation of more than 20 kV/mm has proven to be suitable with respect to the best possible protection against a short-circuit. The insulating layer should preferably have an electric dielectric strength of at least 2,000 V in the direction across the layer composition.

On the basis of the inventors' practical experiments, it has been determined that the insulating layer should preferably comprise both a ceramic plate and a plastic foil. The combination of both elements can form the required insulating characteristics in the best possible way. The ceramic plate can, for example, be formed from aluminium oxide with thermal conductivity of 24 W/(m K) and electrical insulation of 28 kV/mm. The plastic foil can, for example, be a polyamide foil that, as does the aluminium oxide, has relatively good thermal conductivity of 0.45 W/(m K) and an adequate dielectric strength of 4 kV.

As a relatively flat component, the ceramic plate of the insulating layer can be positioned against the electric strip conductor across the entire surface with high precision. If required, the insulating layer can be glued directly to the electric strip conductor. To improve the thermal conductivity between the strip conductor and the insulating layer, the adhesive should be provided in a layer that is as thin as possible of less than 20 μm. For the same reasons, the plastic foil should preferably be laminated to the ceramic plate. To this end, the foil preferably has a wax layer of between 10 and 15 μm that, particularly under the operating conditions of the heat-generating element, i.e., at higher temperatures of approximately 80° C., and when the insulating layer is pressed against the strip conductor, melts and facilitates efficient heat transfer. In this case, it is necessary to arrange the heating device from layers of heat-generating and heat-emitting elements, extending parallel to one another, in a frame and to hold this layer composition in the frame with a spring bias, as is fundamentally already known from EP 0 350 528, which is traced back to the current applicant. An alternative development was described in EP 1 515 588, for example.

The heat-generating element can be formed by multiple PTC elements, arranged one behind the other, that cover the strip conductors on both sides, as well as by insulating layers that surround the strip conductors on the exterior. All components of this layer composition can be connected to one another, in particular, they can be glued. The electrically conductive insulating layer in this connection should preferably project beyond the electric strip conductor, so that the electrically conductive and energized components of the heat-generating element are located at a distance behind the outer insulating edges of the heat-generating element, meaning that they are provided offset at a distance towards the inside. The electric strip conductor can project beyond the insulating layer only for the formation of an electric contacting point.

In order also to avoid access to the current-carrying parts of the heat-generating element between the insulating layers, and, in particular, for precise positioning of the PTC elements, a further preferred development of the invention under consideration proposes the provision of a positioning frame, known per se, at the heat-generating element, said positioning frame forming a frame opening for holding the at least one PTC element. This positioning frame, known per se, is described, for example, in the aforementioned EP 0 350 528 and is normally manufactured from a non-conductive material, in particular, from a plastic material. The frame is normally formed as a longish component that leaves open a frame opening in the level of the PTC element(s) of the heat-generating element for one or more PTC elements. The PTC element or the PTC elements are positioned in this frame opening.

Regarding the use of relatively high voltages, it is proposed, according to the invention, for the insulating layer to project beyond the strip conductor, at least in the transverse direction of the longish frame, wherein the electric strip conductors and the at least one PTC element are circumferentially spaced at a distance from the positioning frame by an insulating gap. It has been shown that, when high voltages are used, an electric flashover through the thermoplastic material of the positioning frame cannot always be avoided when the electrically conductive parts are directly adjacent to or fitted against the positioning frame. The preferred further development with the insulating gap provides a remedy here against the risk of an electric flashover, by means of realizing a sufficiently large gap between the current-carrying parts and the material of the positioning frame. To maintain this insulating gap, the insulating layer can, for example, be permanently connected to the current-carrying parts of the heat-generating element and, in turn, fixed with respect to the positioning frame. Consequently, it is, for example, possible to form the insulating layer, at least across the width, i.e., at right angles to the length of the longish heat-generating element, with sections that project beyond the current-carrying parts, in particular the electric strip conductor, across the width. These projecting sections of the insulating layer are preferably connected to the positioning frame, for example, via an adhesive layer. With such a development, the current-carrying parts of the heat-generating element, i.e., the PTC element, and the opposite strip conductors fitting against it, can, for example, be completely encapsulated. The insulating layer covers the current-carrying parts on both sides and connects to the edges of the positioning frame, forming a seal. In this way, an electrically non-conductive encapsulation is formed in the circumferential direction of the heat-generating element. In this preferred development, in a cross-sectional view of the heat-generating element, the energized parts, i.e., the electric strip conductors and the PTC elements arranged between them, are located in the middle. This layer composition is bordered by the insulating layer at the top and bottom. This layer, in turn, fits against the positioning frame, formed from plastic, with each of its outer edges forming a seal. In this preferred development, there is no possibility whatsoever that moisture or dirt carried along with the air flowing against the heat-generating element can reach the current-carrying parts. In this preferred development, only the current-carrying parts, especially the contact plates, project beyond the insulating layer on one or both face sides of the heat-generating element. In this position, the electric strip conductors are, however, routinely held in the holding device of the heating device and, by means of the structural elements of this holding device, the current-carrying parts can be sealed with respect to the flowing air.

The electrically non-conductive encapsulation is preferably created by means of having the sections of the insulating layer that project beyond the electric strip conductor sealed from the positioning frame with an intermediate layer of a sealing element. The sealing element is preferably formed from an insulating material, for example, from an elastic plastic. The sealing element here is preferably formed by a plastic adhesive that connects the positioning frame to the insulating layer, so that not only is a circumferential encapsulation of the current-carrying parts effected, but furthermore the current-carrying parts, together with the insulating layers attached to them, are connected to the positioning frame, forming one structural unit.

It is pointed out that the positioning frame can be made of an electrically high-grade insulating material, so that the use of a conventional thermoplastic material can be completely eliminated. Consequently, the positioning frame can, for example, be formed by a uniform silicone component. Likewise, it is possible to form the positioning frame by injecting a highly insulating, preferably adhesive sealing mass between the layers fitting against the opposing side surfaces of the PTC elements. In such a case, the PTC elements can be positioned with respect to the remaining layers of the layer composition for assembling purposes and ultimately fixed in their position by injecting the highly insulating mass. In such a case, the positioning frame does not serve as a positioning aid during assembly, but instead only for ensuring a pre-determined position of the PTC element(s) during long-lasting operation of the heat-emitting element.

If the positioning frame is formed as an injection-moulded component from a high-grade electrically insulating material and is used as a positioning aid during assembly, the layers that oppose each other and that fit against the PTC element can be glued into one structural unit, together with the PTC elements and the silicone frame, by means of inserting an adhesive between these layers. Even in such a case, it is possible to eliminate the use of a conventional injection-moulded part made of a customary thermoplastic for forming the positioning frame.

The electric strip conductor is preferably formed by a contact plate, which projects beyond the at least one PTC element. At least one electric contacting point is formed, on the side that projects beyond the at least one PTC element, by the contact plate, in the form of a plug connector, by means of which the electrical connection of the heat-generating element to a power supply can be made. Accordingly, the contact plate preferably projects beyond the PTC element at least on the face side of the heat-generating element. It is likewise possible, however, to form the contact plate in such a way that it projects beyond the PTC element across the width.

Preferably, the current-carrying contact plates are used in particular to hold the PTC elements within the frame opening formed by the positioning frame. Accordingly, a section of the holding frame extends between the opposing, projecting ends of the contact plates. In other words, the holding frame is also provided between the opposing contact plates, so that the current-carrying parts of the heat-generating element are held in the positioning frame along the height within certain borders. Keeping the insulating gap between the contact plates and the material of the positioning frame can, for example, be effected by an insulating spacing medium, which is provided in the insulating gap between the edge of the contact plate that projects beyond the PTC element and the material of the positioning frame. Preferably, this spacing medium extends in the transverse direction of the positioning frame, up to the outer end of the contact plate. The insulating spacing medium is preferably formed by a plastic material that has a dielectric strength that is higher than that of the material of the positioning frame (e.g., silicone, polyurethane).

Arrangements are conceivable in which the PTC element (s) are loosely held in the frame opening between the two contact plates. This arrangement is particularly to be made when, for reasons of good electric contacting between the PTC elements and the contact plate, there is no gluing of the two parts. In order then to avoid direct laying of the PTC elements on the material of the positioning frame surrounding the frame opening, and in order to ensure that the insulating gap is kept securely, it is proposed, according to a preferred further development of the invention under consideration, that the insulating spacing medium be formed so that it projects beyond this edge surrounding the circumference of this frame opening. The insulating spacing medium is accordingly located in the level that holds the PTC elements, directly adjacent to a face side of the PTC element that lies opposite to the positioning frame.

The sealing element extends at least lengthwise along the positioning frame. With a view to an arrangement and positioning of the sealing element that is as precise as possible, particularly with respect to the projecting ends of the insulating layer, this element is provided adjacent to a sealing medium bordering edge, said edge extending preferably completely along the length of the positioning frame and being formed by the positioning frame. This sealing medium bordering edge extends along the height of the positioning frame, i.e., in a direction that is aligned both at a right-angle to the width of the positioning frame and perpendicular to the length of the positioning frame. The sealing medium bordering edge should preferably extend along the entire length extension of the positioning frame, i.e., it should grip the sealing element at the opposite long sides of the positioning frame.

A bordering edge that in any case reaches, in the height, to the level in which the insulating layer is located, preferably extends in the height direction in the same direction, with a view to positioning of the insulating layer that is as precise as possible. Accordingly, the respective insulating layers are provided between bordering edges that are opposite each other. At the same time, with a view to the greatest possible safety with respect to electric flashover, the face end of the insulating layer is also arranged at a distance to the insulating layer bordering edges. Because the insulating layer is not actually an electrically conductive component, however, it can certainly be tolerated, in view of economic manufacture for the insulating layer, if the insulating layer is in direct contact with the bordering edge on one side. The bordering edges principally serve the precise positioning of the insulating layer across the width of the positioning frame.

In addition to these assembly aids or contact edges that extend in the height direction, the positioning frame preferably likewise has bordering tabs that likewise extend in the height direction, i.e., in a direction at a right angle to the supporting plane of the PTC element. These bordering tabs project beyond the bordering edges and serve to position a heat-emitting element that fits against the heat-generating element. This heat-emitting element fits against the electric strip conductor, with the insulating layer placed in between.

While the bordering edges and the bordering tabs serve the positioning of the insulating layer resp. the heat-emitting elements in the transverse direction of the positioning frame, with a view to positioning of the various components of the heat-generating element that is as precise as possible, according to a further preferred development it is proposed that during the manufacture of the same, at least one attachment bar be provided at the positioning frame, said attachment bar extending at a right angle to the support layer of the PTC element, i.e., extending in the height direction, and said attachment bar serving to fix in place the insulating layer along the length of the positioning frame. Because of the bordering edges of the insulating layer and the attachment bar, the insulating layer is fixed in place relative to the positioning frame during assembly. The insulating layer is accordingly reliably arranged within the specified borders in the width and length directions.

For accurate positioning of the electric strip conductor, which is preferably formed by a contact plate, the positioning frame furthermore has pegs that extend in the height direction, i.e., at right angles to the supporting plane of the PTC element. Each of the pegs is precisely meshed in a cut that is left in the contact plate. By melting the peg, a thickening is formed above the contact plate, and the contact plate is secured to the positioning frame by means of this thickening. In this development, the contact plate is exactly positioned by the positive locking of the peg and cut. The thickening provides a positive locking of the contact plate to the positioning frame. The insulating layer is preferably glued to the unit formed in this way, whereby the glued connection is preferably located between the positioning frame and the insulating layer.

In this way, a pre-mounted structural unit, comprising the positioning frame, the at least one PTC element, the contact plates and the insulating layers, can be formed. When the heat-generating element is later brought together with the heat-emitting element, it is no longer necessary that care be taken during the later procedural steps to ensure that the individual layers of the heat-generating element are precisely positioned in the frame of the final assembly.

According to a preferred further development, the contact plate in any case forms a plug connection at one of its face sides, said plug connection being formed as a single-piece element using sheet metal forming and being shaped in such a way that it extends at a right angle to the plate level. In the mentioned further development, this plug connection is located in a slot that is made in the positioning frame and that opens outwards to a face side of the positioning frame. By means of this development, there is always an electric plug connection on the face side of the positioning frame, it being possible to slide said plug connection into the holding device of a heating device in order to connect the heat-generating element to the power supply.

Preferably, there are two slots located on the face side, and the opposing contact plates, with their plug connections formed by means of sheet metal forming, mesh in the slots recessed into the positioning frame.

In an alternative development, the plug connection is formed in any case by sheet metal forming of the contact plate at its face side. The plug connection preferably extends parallel to the remaining contact plate, but, by being bent, it is located in a level that is spaced outwards to the level that holds the contact plate. This preferred development is particularly suited for such arrangements in which the two contact plates on the same face side form electric connection elements that, with a view to the safest possible insulation and the space requirements of plug holders for the connections, should be spaced far apart.

The heating device according to the invention has multiple heat-generating elements of the type described in the preceding, as well as multiple heat-emitting elements arranged in parallel layers. These heat-emitting elements fit against opposing sides of a heat-generating element. Consequently, in the embodiment according to EP 0 350 528, for example, a heat-emitting element can be provided at each of the opposing sides of the heat-generating element, either directly or with a further element of the layer composition being placed in between. Considered as an element of the layer composition are, in particular, also spring elements that hold the layer composition with initial tension in the frame that forms the holding device. In an alternative development in accordance with EP 1 061 776, a large number of radiator elements, provided at right angles to the profile closed around the circumference, fit against the profile closed around the circumference, said profile holding the heat-generating element. According to the invention, each heat-emitting element fits against the opposing sides of the heat-generating element, with an insulating layer in between. Accordingly, there is an insulating layer on each side of the heat-generating element, said insulating layer being located between the PTC element and the heat-emitting elements created by the PTC element. Consequently, there is an insulating layer on the two opposing sides of the heat-emitting element, with said insulating layer transferring heat to the heat-emitting element.

The heating device according to the invention is further developed by the further development already discussed in the preceding with reference to the heat-generating element.

Further details and advantages of the invention under consideration result from the following description of embodiments, in conjunction with the drawing. These figures show:

DETAILED DESCRIPTION OF THE PREFERRED EMBODIMENT

Figure 1:
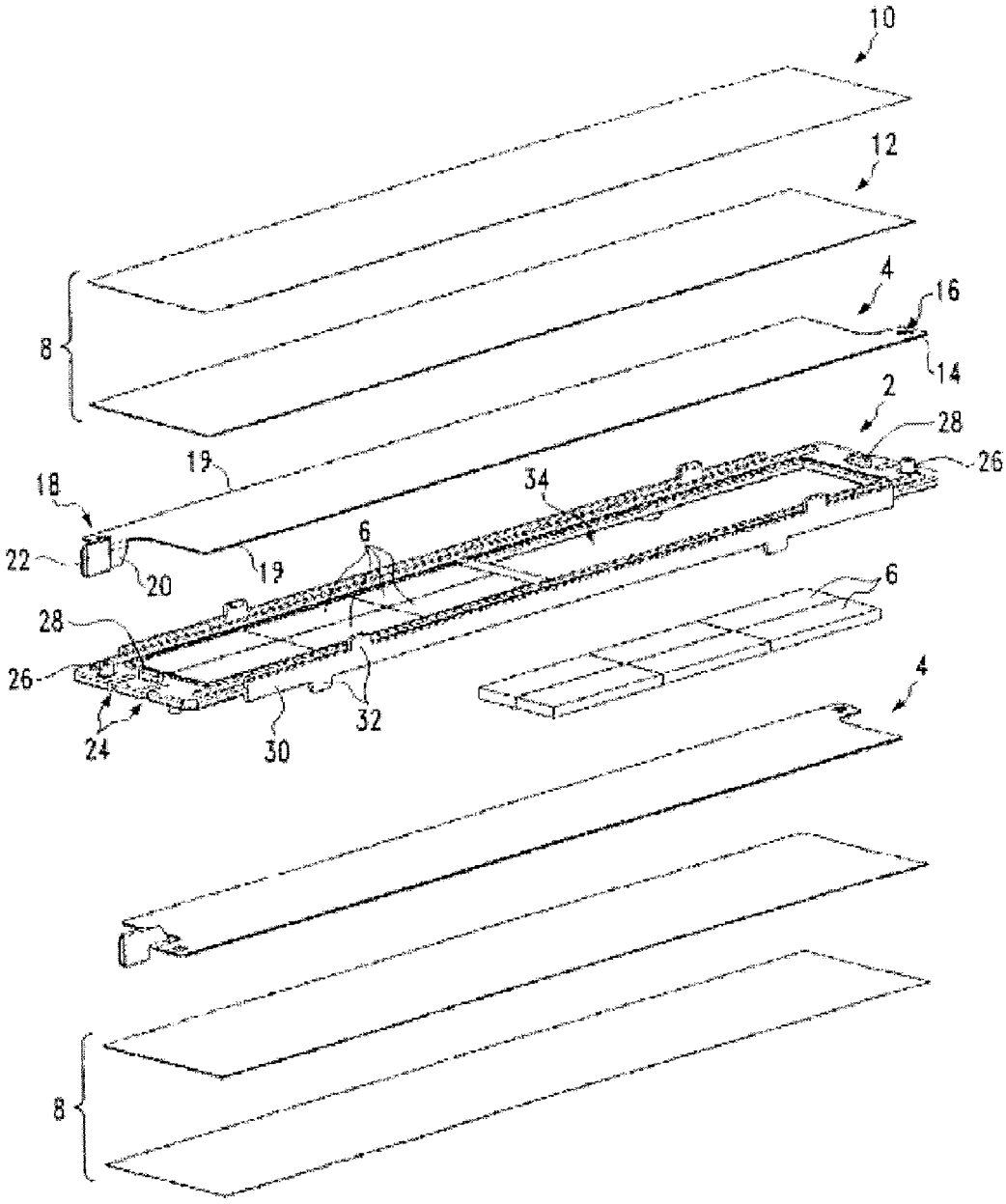
FIG. 1 a perspective side-view onto an embodiment of a heat-generating element in a blown-up representation.
Figure 2:
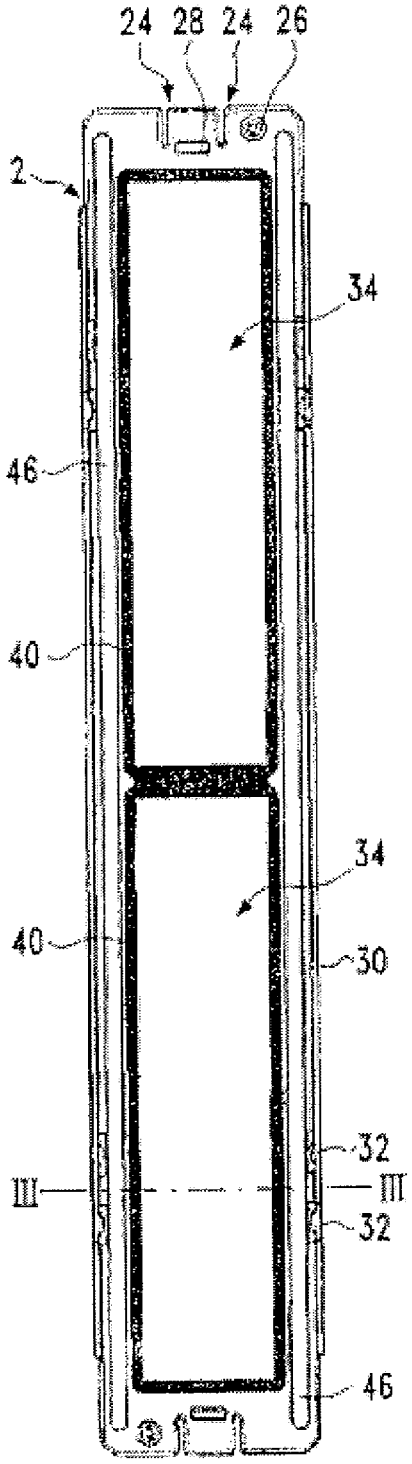
FIG. 2 a top view of the embodiment shown in FIG. 1.

FIG. 1 shows a perspective side-view of the essential parts of an embodiment of a heat-generating element in a blown-up representation. The heat-generating element has a positioning frame 2, made of injection-moulded plastic, whose middle longitudinal axis forms a bisecting plane of the heat-generating element. This element is essentially formed with one side the mirror image of the other, and initially has contact plates 4 provided on each side of the positioning frame 2, said contact plates holding between them the PTC elements 6 held in the positioning frame 2. On the exterior side of the contact plates 4 is located a two-layer insulating layer 8, comprising an exterior insulating foil 10 and an inner ceramic plate 12, that fits directly against the contact plate 4. The ceramic plate 12 is a relatively thin aluminium oxide plate that provides very good electric dielectric strength of roughly 28 kV/mm and good thermal conductivity of more than 24 W/(m K). The plastic foil 10 in this case is formed by a polyamide foil that has good thermal conductivity of roughly 0.45 W/(m K) and dielectric strength of 4 kV. Located between the plastic foil 10 and the ceramic plate 12 is a wax layer, with a thickness of a few μm, whose melting point is coordinated with regard to the operating temperature of the heat-generating element, namely in such a way that the wax melts at the operating temperature and becomes distributed between the plastic foil and the ceramic plate 12, which fit closely together under compressive stress, with the distribution being of such a manner that a levelling film is created that furthers good heat transfer between the two parts 10, 12 of the insulating layer 8. The combination of plastic foil 10 and ceramic plate 12 leads to an insulating part 8 that has good electrical characteristics and thermal conductivity characteristics and, particularly with respect to voltages of up to 2,000 V, is not subject to flashover, but which simultaneously displays the necessary strength. Any stress peaks that can, in particular, be generated by pressure against heat-emitting elements that fit against the heat-generating element, are relieved and homogenized by the insulating foil positioned on the exterior. The wax that is arranged between the two parts 10, 12 of the insulating layer, as well as, optionally, an adhesive that is also provided there and that connects the two parts 10, 12 to one another, furthers this relief of stress peaks. Accordingly, there is no risk of the relatively brittle ceramic layer breaking, even at higher compressive stresses that hold a layer composition of heat-generating and heat-emitting elements under an initial tension.

The insulating layer 8 is preferably glued to the exterior side of the contact plate 4. This is located roughly centred, below the insulating layer 8, and is formed with a width less than that of the insulating layer 8. The respective contact plate 4 projects beyond the insulating layer 8, however, at the face sides. The width of the contact plate 4 is initially considerably reduced at these ends that project beyond the insulating layer 8. At the right end as seen in FIG. 1, the contact plate 4 has an attachment tab 14, which is narrowed by cutting free some of the width of the contact plate 4 and into which a cut 16 is made. At the opposite end, shown in FIG. 1 at the left, a corresponding narrowed attachment tab 18 with a cut 16 is likewise provided. From the side edge of this attachment tab 18, a tab 20, bent out of the level of the contact plate 4, goes off, forming the basis of a plug connection 22 that projects beyond the positioning frame 2 on the face side.

Figure 4:
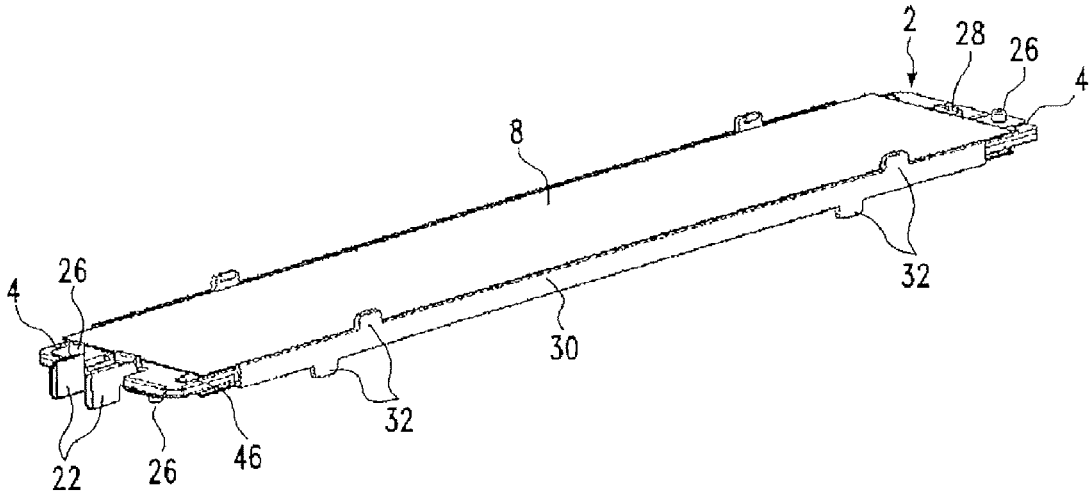
FIG. 4 a perspective side-view of the embodiment shown in FIG. 1 to 3, in the assembled state.

The tab 20 meshes with a slot 24 cut into the positioning frame 2, with said slot 24 opening towards the face side of the positioning frame 2. On its face side end regions, the positioning frame 2 furthermore has pegs 26, that extend in the height direction of the heat-generating element, i.e., that go off at a right angle from the surface of the positioning frame 2. During assembly, these pegs 26 are introduced into the cuts 16. Subsequently, the peg 26 is melted to form a thickening of melted material and the contact plate 4 is secured to the positioning frame 2 in this manner. As can be derived in particular from FIGS. 1 and 4, the positioning frame 2 has, in addition to the pegs 26, additional positioning aids for precise arrangement of the contact plate 4 on the positioning frame 2. In this way, the positioning frame 2 forms, firstly, face-sided attachment pegs 28 on the face-sided ends of the contact plate 4, said attachment pegs 28 extending slightly beyond the upper side of the contact plate 4 and being spaced at a distance to one another that roughly corresponds to the length of the contact plate 4. In this way, the contact plate 4 is positioned lengthwise. Secondly, across the width, the positioning frame 2 forms bordering edges 30 that extend along almost the entire length of the contact plate 4, said bordering edges 30 likewise extending beyond the upper side of the contact plate 4 and being spaced at a distance to one another that is slightly larger than the width of the contact plate 4. Projecting beyond this bordering edge 30 on both sides are bordering tabs 32 with locking protuberances in the interior, by means of which a heat-emitting element that is arranged on the heat-generating element can be fixed in place for assembly purposes.

Figure 3:
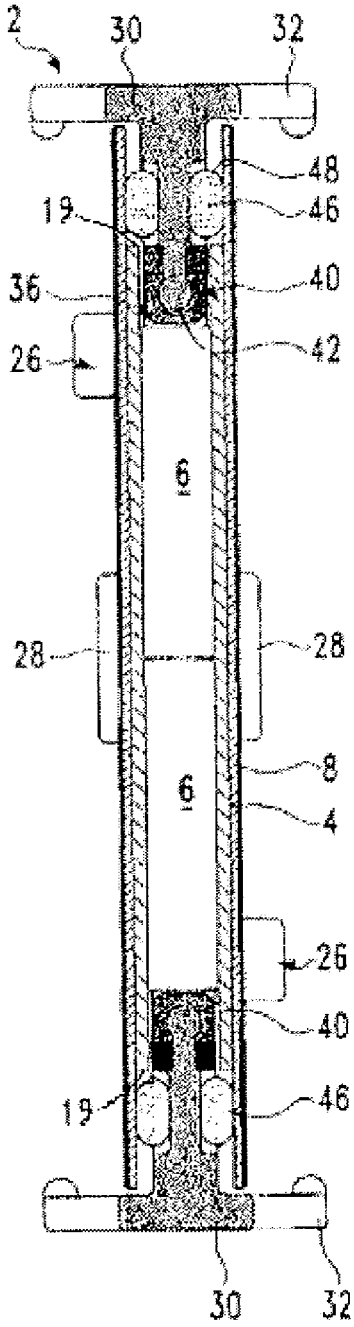
FIG. 3 a cross-sectional view along the line III-III according to the depiction in FIG. 2.

In the heat-generating element, as can be seen in FIG. 3, opposing surfaces of the PTC elements 6 fit against the interior surfaces of the contact plate 4, which are fixed in place in a frame opening 34 of the positioning frame 2. As can be seen in FIG. 1, six PTC elements 6 are located within each frame opening 34. Two equally sized frame openings 34 are provided, arranged one behind the other along the length. The PTC elements are packed at a distance to the material of the positioning frame 2 by means of an insulating gap 36. This insulating gap 36 also extends in a direction parallel to the supporting plane, between the interior side of the contact plate 4 and a narrowed interior edge 38 of the positioning frame that surrounds the circumference of the frame opening 34. Accordingly, the current-carrying parts of the heat-generating element, i.e., the two contact plates 4 and the PTC elements 6, are spaced at a distance from the material of the positioning frame 2 by means of the insulating gap 38. In the embodiment shown in FIG. 1 to 4, this distance is ensured by an insulating spacing medium 40, which surrounds the front end of the interior edge 38 around the circumference. In the embodiment shown, the insulating spacing medium 40 is formed by a silicone strip that holds the front area of the interior edge 38 and surrounds it around the circumference.

It is not absolutely required that the current-carrying parts of the heat-generating element fit directly against the insulating spacing medium 40. Rather, the spacing medium is only intended to prevent the current-carrying parts from coming into direct contact with the plastic material of the positioning frame 2. The insulating characteristics of the spacing medium 40 are selected in such a way that in any case, it has a better insulating effect than does the plastic material of the positioning frame 2. The length of the spacing medium 40 across the width is selected in such a way that in any case, it extends to the end of the contact plate 4 corresponding to the width, whereby, e.g., the edge 19 of the electric strip conductor can extend beyond the PTC element 6 yet be spaced from the material of positioning frame 2 by the insulating spacing medium 4 (FIG. 3). The spacing medium 40 covers the sides of the interior edge 30 that are open to the top and to the bottom, as well as an edge 42 that is formed by the interior edge 38 and that surrounds the frame opening 34 around the circumference.

The spacing medium 40 can accordingly also be understood as the interior insulating jacket coating the edge surrounding the circumference of the frame opening 34, which prevents both direct contact between the PTC element 6 and the thermoplastic material of the positioning frame 2 and direct contact of the contact plates 4 to the positioning frame 2, and ensures a minimum distance between the named parts that is to be maintained for the electrical insulation.

In addition to electrical insulation of the current-carrying parts of the heat-generating element, the embodiment shown in FIG. 1 to 4 also provides complete encapsulation of these parts. To this end, the insulating layer has an edge section 44 that extends across (FIG. 3) the contact plate 4 on both sides. Between this edge section 44 and the interior edge 38 of the positioning frame 2 is located a sealing element 46, which is positioned in such a manner that it lies against and forms a seal with both the positioning frame 2 and the insulating layer 8. In the circumferential direction, i.e., across the width, the encapsulation accordingly has the opposing insulating layers 8 and the arrangement of two sealing elements 46, which extend essentially at right angles, with the material of the positioning frame 2 provided between them. The encapsulation is selected in such a way that no moisture or dirt can penetrate into the current-carrying parts from outside.

The sealing element 46 is formed by a plastic adhesive that fixes the insulating layer 8 in place with respect to the positioning frame 2, consequently enclosing all parts of the heat-generating element provided within the insulating layer 8. In this development, it is possible to do without fixing the PTC elements 6 in place to the contact plates 4 with respect to the insulating layer 8, with a view to positioning during operation of the heat-generating element. Nevertheless, for manufacturing reasons, such an attachment may be expedient.

Elastomers, for example, silicone or polyurethane, have proven suitable for forming the sealing element 46 in the form of an adhesive. As can particularly be derived from FIG. 2, the sealing element 46 extends along the length of the positioning frame and is provided between the outer edge of the frame opening 34 and the bordering edge 30. The sealing element fits against the interior edge 38, which has a reduced thickness. On the exterior side, directly adjacent to the sealing element 46, a sealing medium bordering edge 48 is provided that is formed by the positioning frame 2. With a view to the best possible sealing, the sealing element 46 can fit closely against this edge that extends at right angles to the accommodating level for the PTC elements.

Figure 5:
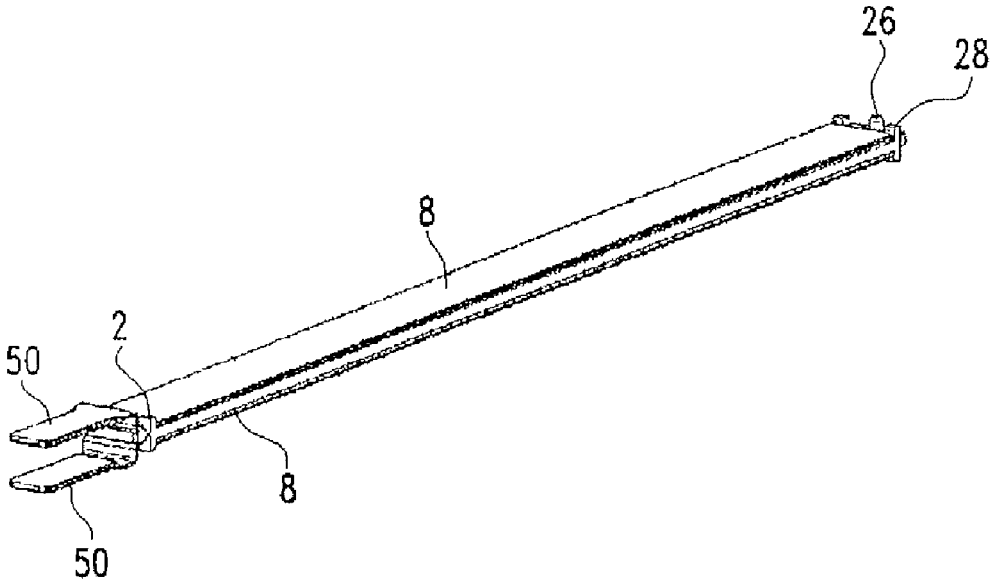
FIG. 5 a perspective side-view of a further embodiment of a heat-generating element.
Figure 6:
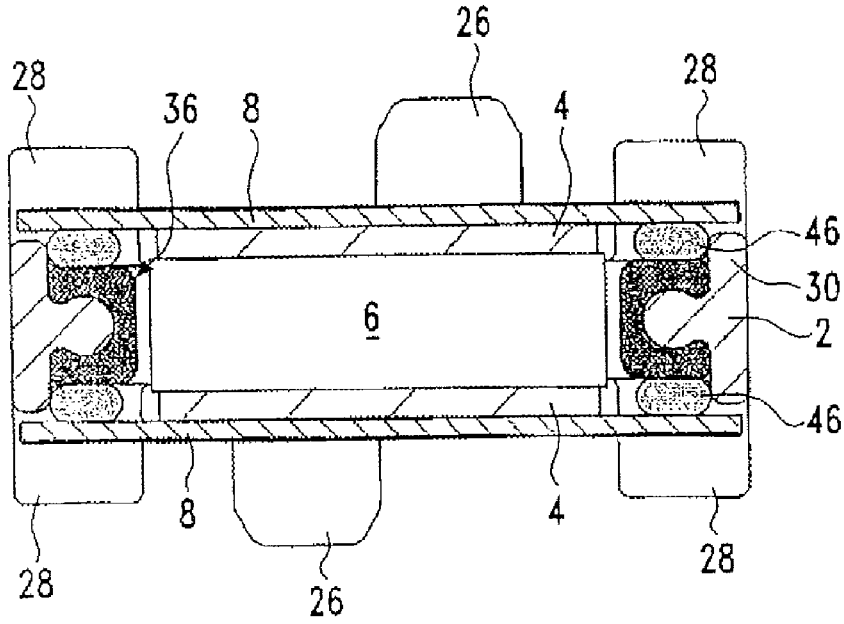
FIG. 6 a cross-sectional view along the line V-V according to the depiction in FIG. 4.

FIGS. 5 and 6 show an alternative embodiment of the heat-generating element according to the invention. Components that are the same as those in the already discussed embodiments are identified with the same reference numbers.

The embodiment shown in FIGS. 5 and 6 is narrower, i.e., it can be formed with a width that is less than that of the previously discussed embodiment. This is due to the fact that the sealing element 46 lies directly against the spacing medium 40, as can be seen in the sectional view according to FIG. 6. Each contact plate 4 has a width roughly corresponding to the width of the PTC element. Only one PTC element 6 is arranged in each of the frame openings 34. Multiple PTC elements 6 are arranged, one behind the other, along the length of the positioning frame 2. The insulating layer 8 extends across the width to the outer edge of the positioning frame 2. The bordering edge 30 serves merely for the arrangement of the sealing element 46 at the side. The sealing layer 8 likewise extends at a distance with respect to the height, to the upper edge of the bordering edge 30, so that any deviations in aligning the insulating layer 8 regarding the width with respect to the positioning frame 2 can be compensated for without interfering with the capability of the heat-generating element.

In the embodiment shown in FIGS. 5 and 6, the current-carrying parts are also encapsulated around the circumference. In a direction at a right angle to the supporting plane of the PTC elements 6, this encapsulation is formed by the two sealing elements 46 and the spacing medium 40 arranged between them.

Across the width, the exterior surface of the heat-generating element is completely level and is formed solely by the exterior surface of the insulating layer 8. Only in the area of the ends on the face sides are elements that project beyond this upper layer 8, where these elements are in the form of pegs 26 that, as already described previously with reference to the first embodiment, mesh in corresponding cuts 16 in the contact plates 4. Furthermore, attachment pegs 28 project beyond the upper side, said pegs serving in this embodiment particularly the positioning of the heat-emitting segments along the length.

To be cited as a further difference is the fact that the contact plates 4 are bent outwards at the face sides, where they form plug connections 50 that extend essentially parallel to the level of the contact plate 4. The positioning frame 2 extends along the length until beyond the area of the contact plate 4 that is bent outwards, consequently offering reliable insulation and spacing of the two current-carrying components.

It is pointed out that, in the embodiment shown in FIG. 5, it is also possible to provide only a single plug connection 50, instead of two plug connections. In this case, the energizing of the other contact plate 4 can, for example, be accomplished by means of a structural component of the holding device for holding the heat-generating elements, for example, by means of the attachment tab 14, which projects beyond the insulating layer 8 at the face side opposite the plug connection 50.

Figure 7:
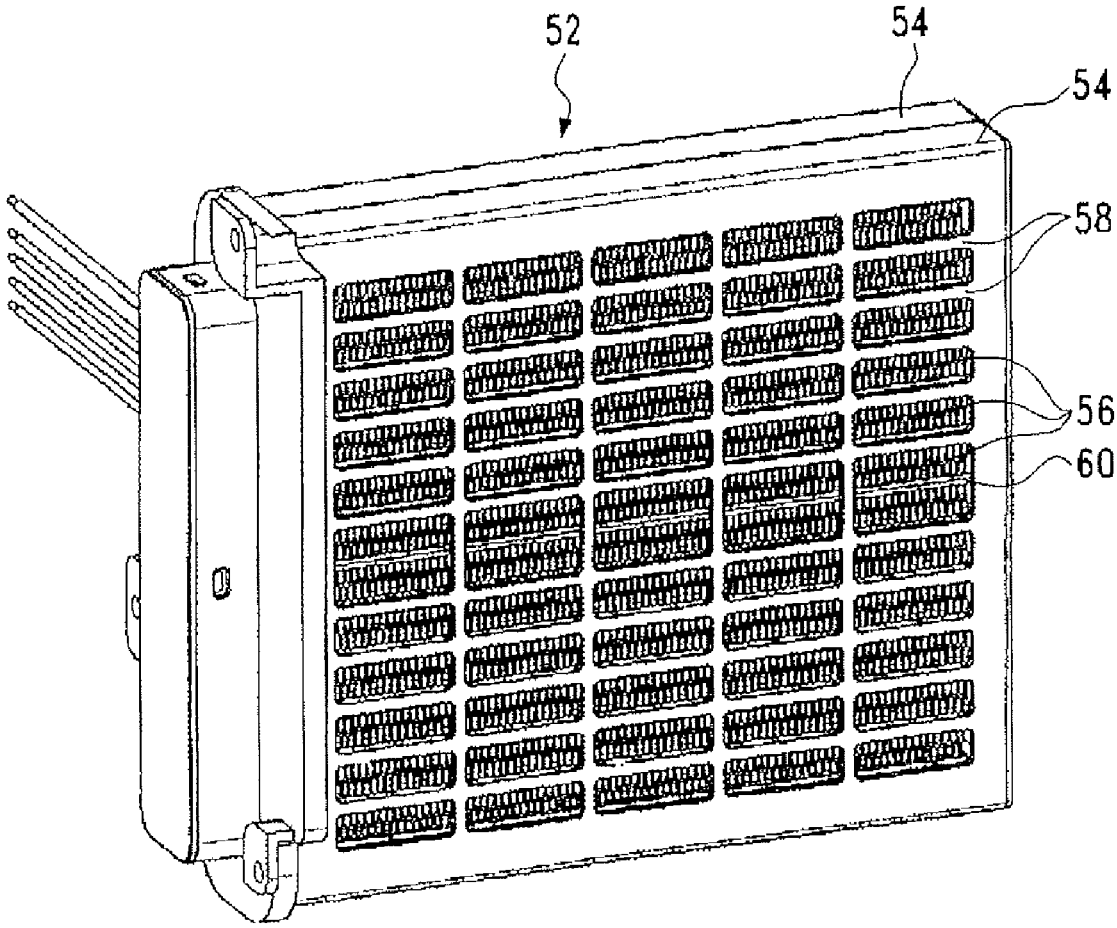
FIG. 7 a perspective side-view of an embodiment of a heating device.

FIG. 7 shows an embodiment of a heating device according to the invention. This comprises a holding device in the form of a frame 52 closed around the circumference, which is formed from two frame hulls 54. Within this frame 52, multiple layers of identically formed heat-generating elements (for example, according to FIG. 1 to 4), running parallel to one another, are held. Furthermore, the frame 52 contains a spring (not shown), by means of which the layer composition is held in the frame 52 at an initial tension. Preferably, all heat-emitting elements 56 are arranged directly adjacent to a heat-generating element. The heat-emitting elements 56 shown in FIG. 7 are formed by means of strips of aluminium plating bent in a meandering fashion. The heat-generating elements are located between these individual heat-emitting elements 56 and behind the lengthwise bars 58 of one of the air inlet or outlet openings of the grid that penetrates the frame 52. One of these lengthwise bars 58 is removed from the middle of the frame 52 for the purposes of the depiction, so that a heat-generating element 60 can be seen there.

Because the heat-emitting elements 56 fit closely against the current-carrying parts, with an insulating layer 8 placed in between, the heat-emitting elements 56, i.e., the radiator elements, are potential-free. The frame 52 is preferably formed from plastic, as a result of which the electrical insulation can be further improved. Additional protection, particularly against unauthorized contact with the current-carrying parts of the heating device, is additionally provided by the grid, which is likewise formed from plastic and developed as a single piece with the frame hulls 54.

On one face side of the frame 52, a plug connection is located in a manner known per se, with power supply lines and/or control lines going off of it, by means of which the heating device can be connected for control and power supply purposes in a vehicle. On the face side of the frame 52, a housing is indicated which can also have control or regulating elements, in addition to the plug connection.

We claim:

1. A heating device for heating air, the heating device comprising:

a frame defining an external perimeter of the heating device;

multiple heat-generating elements housed within the frame, each of the multiple heat-generating elements comprising:

at least one PTC element;

electric strip conductors lying on opposing side surfaces of the PTC element; and multiple heat-emitting elements that are arranged in parallel layers and, lying on opposing sides of the heat-generating element, that are held in position, wherein each of the heat-emitting elements fits against the opposing sides of the heat-generating element with an insulating layer in between, wherein the insulating layers electrically insulate the electric strip conductors from the heat-emitting elements, mitigating any electrical potential between respective ones of the heat-emitting elements during high voltage uses; and a spring contained within the frame and holding the multiple heat-generating and heat-emitting elements in a state of initial tension within the frame.

2. The heating device for heating air according to claim 1, wherein each of the insulation layers fits directly against the assigned electric strip conductor and each of the heat-emitting elements abuts against the assigned insulating layer.

3. The heating device for heating air according to claim 1, wherein each of the insulating layers comprises a ceramic plate and a plastic foil.

4. The heating device for heating air according to claim 3, wherein the plastic foil is arranged on an exterior side of the ceramic plate, and wherein the heat-emitting element abuts against the plastic foil.

5. The heating device for heating air according to claim 1, wherein each of the insulating layers projects beyond the associated electric strip conductor at least across the width of the electric strip conductor, and wherein the electric strip conductor and the PTC heating element are circumferentially spaced from the material of the positioning frame by an insulating gap.

6. The heating device for heating air according to claim 1, wherein an electrically non-conductive encapsulation is formed by the insulating layer, said non-conductive encapsulation fully encapsulating the PTC element and the electric strip conductors.

7. The heating device for heating air according to claim 1, further comprising a positioning frame, wherein each of the insulating layers has a section that projects beyond the associated electric strip conductor, said section being sealed with respect to the positioning frame, with a sealing element as an intermediate layer, and wherein the sealing element is formed by a plastic adhesive that connects the insulating layer to the positioning frame.

8. The heating device for heating air according to claim 1, further comprising a positioning frame, wherein the positioning frame forms bordering edges extending at a right angle to a supporting plane of the PTC element and bordering the sides of an accommodation for at least one of the insulating layers and the electric strip conductors.

9. The heating device for heating air according to claim 8, wherein the positioning frame forms bordering tabs that extend at a right angle to a supporting plane of the PTC element and that project beyond the bordering edges, said bordering tabs serving to position a heat-emitting element that fits against the heat-generating element.

10. The heating device for heating air according to claim 5, wherein an insulating spacing medium is arranged in the insulating gap, at least between an edge of the electric strip conductor that projects beyond the PTC element and the material of the positioning frame.

11. The heating device for heating air according to claim 1, further comprising a positioning frame coplanar with and extending about a perimeter of the PTC element, wherein the positioning frame, the PTC element, the electric strip conductors and the insulating layers form a pre-assembled structural unit.

12. The heating device for heating air according to claim 1, wherein each insulating layer seals the assigned electric strip conductor from the environment, preventing dirt or splash water from coming into direct contact with the electric strip conductors.

13. A heating device for heating air, the heating device comprising:

a frame having an outer perimeter and defining a void space therein;

multiple heat-generating elements housed in the void space of the frame, each of the multiple heat-generating elements comprising:

a PTC element having first and second opposing surfaces;

a pair of electric strip conductors with inwardly facing surfaces in face-to-face communication with the first and second opposing surfaces of the PTC element, and outwardly facing surfaces facing away from the PTC element;

a pair of insulating layers entirely covering the outwardly facing surfaces of the electric strip conductors, each of the insulating layers including, a ceramic plate; and a plastic foil; and a pair of heat-emitting elements overlying the insulating layers, wherein the insulating layers sufficiently insulate the heat-emitting elements from the electric strip conductors sufficiently to render the heat-emitting elements at least substantially potential-free when the heat-generating elements operate at a high voltage; and a spring contained within the frame and holding the multiple heat-generating and heat-emitting elements in a state of initial tension within the frame.

14. The heating device for heating air according to claim 13, wherein the heat-generating element operates at an electrical potential of up to about 500 V.

15. A heating device for heating air, the heating device comprising:

a frame having an outer perimeter and defining a void space therein;

multiple heat-generating elements housed within the void space of the frame, each of the multiple heat-generating elements comprising:

a PTC element having first and second opposing surfaces;

a pair of electric strip conductors overlying the first and second surfaces of the PTC element, each of the pair of electric strip conductors having an inside surface facing the PTC element and an outside surface facing an opposing direction;

a pair of insulating layers overlying the electric strip conductors, each of the insulating layers including, a first layer component defined by a ceramic plate that sits upon the outside surface of a respective electric strip conductor; and a second layer component defined by a plastic foil that sits upon the ceramic plate, whereby the ceramic plate is sandwiched between the plastic foil and the electric strip conductor; and a pair of heat-emitting elements overlying the insulating layers, wherein each of the insulating layers has a thermal conductivity value and a dielectric strength value that that permit heat transfer to the heat-emitting elements and eliminate electric flashover between the electric strip conductors, and wherein the insulating layers electrically insulate the electric strip conductors from the heat-emitting elements, mitigating any electrical potential between respective ones of the heat-emitting elements during high voltage uses; and a spring contained within the frame cooperating with the multiple heat-generating and heat-emitting elements and holding the multiple heat-generating and heat-emitting elements in a state of initial tension within the frame.

16. The heating device for heating air according to claim 15, wherein the insulating layer has a dielectric strength value of at least 2,000 V.

17. The heating device for heating air according to claim 15, wherein each heat-generating element operates at an electrical potential of up to about 500 V.

* * * * *